US010006259B2

(12) United States Patent
Angelle et al.

(10) Patent No.: US 10,006,259 B2
(45) **Date of Patent: *Jun. 26, 2018**

(54) LARGE DIAMETER TUBULAR LIFTING APPARATUSES AND METHODS

(71) Applicant: Frank's International, LLC, Houston, TX (US)

(72) Inventors: Jeremy Richard Angelle, Lafayette, LA (US); Logan Essex Smith, Youngsville, LA (US)

(73) Assignee: Frank's International, LLC, Houston, TX (US)

( * ) Notice: Subject to any disclaimer, the term of this patent is extended or adjusted under 35 U.S.C. 154(b) by 204 days.

This patent is subject to a terminal disclaimer.

(21) Appl. No.: 14/834,352

(22) Filed: Aug. 24, 2015

(65) Prior Publication Data

US 2015/0361738 A1 Dec. 17, 2015

Related U.S. Application Data

(63) Continuation-in-part of application No. 13/790,490, filed on Mar. 8, 2013, now Pat. No. 9,115,548, which (Continued)

(51) Int. Cl.
*E21B 19/07* (2006.01)
*E21B 19/06* (2006.01)
(Continued)

(52) U.S. Cl.
CPC ..... *E21B 19/07* (2013.01); *B66C 1/12* (2013.01); *E21B 19/06* (2013.01); *E21B 19/10* (2013.01); *E21B 19/155* (2013.01)

(58) Field of Classification Search
CPC ..... E21B 19/07; E21B 19/06; E21B 19/155; E21B 19/10
See application file for complete search history.

(56) References Cited

U.S. PATENT DOCUMENTS 1,433,624 A 10/1922 Johnston
1,475,146 A 11/1923 Septer
(Continued)

FOREIGN PATENT DOCUMENTS

AT 335910 T 9/2006
CA 2403705 A1 8/2002
(Continued)

OTHER PUBLICATIONS

Patent Examination Report No. 1 issued in the counterpart Australian Patent Application No. 2015201002, dated Dec. 5, 2015 (2 pages).

(Continued)

*Primary Examiner* — D. Andrews
*Assistant Examiner* — Jonathan Malikasim
(74) *Attorney, Agent, or Firm* — Osha Liang LLP

(57) ABSTRACT

A lifting elevator includes a first elevator segment having a first plurality of slips, a second elevator segment having a second plurality of slips, and a hinge. The first elevator segment and the second elevator segment each have a swept angle of about 180°, and each of the first plurality of slips and the second plurality of slips includes a die configured to grip an external surface of a pipe.

10 Claims, 14 Drawing Sheets

Related U.S. Application Data is a continuation of application No. 12/819,703, filed on Jun. 21, 2010, now Pat. No. 9,115,547.

(60) Provisional application No. 61/219,328, filed on Jun. 22, 2009.

(51) Int. Cl.

| | |
|---|---|
| ***E21B 19/10*** | (2006.01) |
| ***E21B 19/15*** | (2006.01) |
| ***B66C 1/12*** | (2006.01) |

(56) References Cited

U.S. PATENT DOCUMENTS

| | | | | |
|---|---|---|---|---|
| 2,109,493 | A * | 3/1938 | Lundeen | E21B 19/07 188/67 |
| 2,442,249 | A | 5/1948 | Schultz | |
| 3,494,484 | A * | 2/1970 | McFadden | E21B 19/06 294/110.1 |
| 3,532,229 | A * | 10/1970 | Scaggs | E21B 19/155 414/22.58 |
| 3,675,278 | A | 7/1972 | Powell | |
| 3,902,751 | A | 9/1975 | Burkepile et al. | |
| 3,991,887 | A | 11/1976 | Trout | |
| 4,098,532 | A | 7/1978 | Phillips | |
| 4,269,554 | A | 5/1981 | Jackson | |
| 4,361,940 | A | 12/1982 | McFadden | |
| 4,437,515 | A * | 3/1984 | Boyadjieff | E21B 15/00 166/77.4 |
| 4,792,172 | A | 12/1988 | Montanari et al. | |
| 4,823,919 | A | 4/1989 | Hayatdavoudi | |
| 4,834,604 | A | 5/1989 | Brittain et al. | |
| 5,340,182 | A | 8/1994 | Busink et al. | |
| 5,848,647 | A | 12/1998 | Webre et al. | |
| 5,992,801 | A | 11/1999 | Torres | |
| 6,494,273 | B1 | 12/2002 | Martin | |
| 6,527,047 | B1 * | 3/2003 | Pietras | E21B 19/06 166/77.51 |
| 6,651,737 | B2 | 11/2003 | Bouligny et al. | |
| 7,178,626 | B2 | 2/2007 | Matherne et al. | |
| 2002/0096337 | A1 | 7/2002 | Bouligny et al. | |
| 2009/0014169 | A1 | 1/2009 | Bouligny, Jr. et al. | |
| 2009/0120649 | A1 | 5/2009 | Cerovsek | |
| 2013/0186643 | A1 | 7/2013 | Angelle et al. | |
| 2013/0284448 | A1 | 10/2013 | Fraczek et al. | |

FOREIGN PATENT DOCUMENTS

| | | | |
|---|---|---|---|
| DE | 60213758 | T2 | 8/2007 |
| EP | 1354122 | A1 | 10/2003 |
| NO | 20024548 | A | 11/2002 |
| WO | 02059449 | A1 | 8/2002 |
| WO | 2005106185 | A1 | 11/2005 |

OTHER PUBLICATIONS

International Search Report and Written Opinion for International Application PCT/US2010/039450, dated Feb. 1, 2011 (10 pages).

Notification Concerning Transmittal and Written Opinion for International Application No. PCT/US2010/039450 dated Jan. 12, 2012 (7 pages).

Office Action issued in U.S. Appl. No. 12/819,703, dated May 3, 2013 (17 pages).

Office Action issued in U.S. Appl. No. 13/790,490, dated Jun. 19, 2013 (19 pages).

Office Action in corresponding U.S. Appl. No. 13/790,490 dated Dec. 24, 2013 (20 pages).

Office Action issued in related U.S. Appl. No. 12/819,703 dated Apr. 16, 2014 (15 pages).

Office Action in corresponding U.S. Appl. No. 13/790,490 dated Apr. 15, 2014 (18 pages).

Office Action in counterpart United Kingdom Patent Application No. 1406847.2, dated Jul. 23, 2014 (2 pages).

Office Action in corresponding U.S. Appl. No. 13/790,490 dated Nov. 18, 2014 (25 pages).

International Search Report and Written Opinion dated Jul. 26, 2016, in corresponding International Application No. PCT/US2016/028883 (20 pages).

* cited by examiner

LARGE DIAMETER TUBULAR LIFTING APPARATUSES AND METHODS

BACKGROUND OF THE DISCLOSURE

Field of the Disclosure

The present disclosure relates to apparatuses and methods to lift and install large-diameter tubulars with a drilling rig. More particularly, the present disclosure relates to apparatuses and methods to raise horizontal sections of large-diameter pipe to mount them atop vertical strings of large-diameter pipe. More particularly still, the present disclosure relates to apparatuses and methods to raise horizontal sections of conductor pipe to install them atop vertical strings of conductor pipe extending into a wellbore and lowering the conductor strings into the wellbore.

Description of the Related Art

Referring to FIG. 11, a perspective view is shown of a drilling rig 50 used to run tubular members 52 (e.g., casing, drill pipe, etc.) downhole into a wellbore. As shown, drilling rig 50 includes a frame structure known as a "derrick" 54 from which a traveling block 56 and an elevator 58 and/or a top drive (not shown) may be used to manipulate (e.g., raise, lower, rotate, hold, etc.) a tubular string and single tubular members 52. As shown, traveling block 56 is a device that is suspended within the derrick 54, in which traveling block 56 may move up-and-down (i.e., vertically as depicted) to raise or lower a tubular string and single tubular members 52. As shown, traveling block may be a simple "pulley-style" block and may have a hook 60 from which objects below (e.g., elevator 58) may be hung. Additionally, elevator 58 may also be coupled below traveling block 56 and/or a top drive (not shown) to selectively grab or release a tubular string and single tubular members 52 as they are to be raised or lowered within and from derrick 54. Typically, elevator 58 includes movable gripping components (e.g., slips) movable between an open position and a closed position (shown in FIG. 11). In the closed position, the movable components form a load bearing ring within which a tubular string and single tubular members 52 may be gripped. In the open position, the movable components of elevator 58 may move away from one another to allow the tubular members 52 to be brought within or removed from elevator 58.

When assembling a string of tubular members 52 together, the tubular members 52 may be removed from a pipe rack 62 and pulled, or otherwise transported, towards an access opening 64, for example, a v-door, within the derrick 54 of the drilling rig 50. The tubular members 52 may be loaded onto a pipe ramp 66 adjacent to the access opening 64, in which a rigidly mounted end stop 68 may abut the ends of the tubular members 52 to support the tubular members 52 up against access opening 64.

Tubular-shaped goods have a variety of uses in oilfield operations including, but not limited to, drill pipe, drill collars, casing, continuous coiled tubing, and the like. One such tubular-shaped good used in exploration and drilling is conductor pipe. Generally, conductor pipe (e.g., drive pipe) is large-diameter pipe (e.g., between about 50 cm and 122 cm (between 20" and 48") in diameter), usually constructed of steel, that extends from the wellhead into the earth or ocean floor. As such, a string of conductor pipe sections (i.e., a conductor string) is typically the first string of "casing" run into the wellbore, and serves to stabilize the sediment surrounding the wellbore to prevent it from caving-in.

Installation of the conductor string may be performed any number of ways. On land, the conductor string may be driven into the ground from above with an impact loading hammer apparatus. In certain locations, excavation may be necessary prior to driving the conductor string into the uncovered sediment. Offshore, conductor strings may similarly be installed, using impact driving and excavation techniques. In undersea environments, conductor strings may be "jetted in", for example with a pressurized fluid discharged (e.g., seawater) at a distal end of the conductor string displacing the sediment as the conductor string is advanced into the sea floor. Following such a jetting process, an impact driving process may be performed to force the conductor string further into the sea floor, if desired. Additionally or alternatively, in undersea environments, conductor strings may be "sucked" into the sea floor by filling the string with water, sealing the conductor string, and then pumping, or evacuating, the trapped water from the inner bore of the conductor string. As the water is removed from the sealed bore of the conductor string, the conductor is plunged deeper into the sea floor as the sea floor sediment replaces the evacuated water. Following such a suction process, an impact driving process may be performed to force the conductor string further into the sea floor, if desired. Alternatively, impact driving may be performed simultaneously as the conductor string is jetted or sucked into the sea floor.

While conductor strings are relatively the largest (diameter) and shortest (length) strings of casing used to case a wellbore, the strings are still long enough to be assembled from several sections, or joints, of conductor pipe. As such, because of their large diameter and desired permanent placement about the wellbore, conductor strings are typically assembled, on site, from several joints of conductor pipe 20-40 feet long, and may be threaded or welded together end-to-end.

Historically, assembling strings of conductor pipe on the rig floor has been a difficult and time-consuming process. In one example method, to install a new joint of conductor pipe atop a string conductor pipe already engaged into the wellbore, a series of lifting eyes and handling eyes are preinstalled to the outer periphery of the large diameter and heavy-walled joint of conductor pipe to be added. In particular, a pair of heavy-duty lifting eyes are preinstalled, typically 180° apart near the upper-most end of conductor pipe. Next, at least one single joint handling eye is provided at the opposite end of the conductor pipe segment and aligned radially within one of the heavy duty lift eyes.

As such, using various rigging and sling mechanisms, a crane may secure the bottom end of the horizontal conductor pipe (from a handling eye) while another crane (or the rig draw works) raises the upper end so that the formerly horizontal joint of conductor pipe may be held in a vertical position. Once moved into place atop the string of conductor pipe already engaged into the wellbore (and held in location by its heavy duty lifting eyes), the joint of conductor pipe to be added may be threaded together and/or welded in place to the string already in the wellbore. With the new joint of conductor pipe attached, the single joint handling eye of the former topmost joint may be removed and the entire string of conductor pipe may be supported and lowered by the lifting eyes affixed to the outer profile of the newly-added joint until the lower surface of the heavy duty lifting eyes reaches the rig floor at which time the conductor string is supported via compressive loading between the lower surface of the heavy duty lifting eyes and a temporary support plate at the rig floor. Once the conductor string is stationary, a new add on joint is lifted from the horizontal position, as previously described, to the vertical position and added to the conductor string. Once the add on joint is secured to the conductor string, the conductor string can be lifted via the add-on tubular joint. Once the string of conductor pipe is supported by the heavy duty lifting eyes of the new joint, the handling eyes of the new joint are removed, e.g., to minimize resistance in running the conductor string into the wellbore.

However, the installation and removal of the lifting and handling eyes may be problematic in itself. In many cases, bosses, pre-fabricated with the joint of conductor pipe, contain tapped holes to receive the lifting and handling eyes so that high-strength bolts may be used to transfer the load from the eyes to the joint of conductor pipe. Bosses are typically an external protrusion on the outer surface of the conductor pipe. When it comes time to remove the lifting and handling eyes, the bolts may be removed, however the boss remains. As a machining and welding process, the installation and manufacture of the bosses is both time consuming and expensive. Further, as an upset on the outer profile of the joint of conductor pipe, the bosses may add undesired resistance as the conductor string is driven further into the ground about the proposed wellbore and/or may prevent the sediment from re-settling around the conductor string, e.g., not allowing the sediment to sufficiently retain the conductor string in place. As the bosses are typically welded on and bolted to the lifting and handling eyes, they represent possible failure mechanisms that may disrupt operations should a boss, bolt, or lifting eye fail during the installation procedure.

Alternatively, lifting and handling eyes may be directly welded to the outer profile of the joints of conductor pipe. Following use, the welds may be removed by torch cutting and the outer profile of the conductor pipe may be ground smoother such that little or no resistance to being driven remains. However, depending on regulations for the particular location, "hot work" such as torch cutting, welding and grinding may not be allowed to be performed at particular times on the rig floor. Additionally, the processes to weld, remove, and grind smooth the outer profiles of the joints of conductor pipe may represent a tremendous amount of cost to the tubular segments and time investment. Furthermore, during the removal and grinding process, there is opportunity for the outer profile of the joint of conductor pipe to become damaged to the point where it must be replaced or repaired. Repairing a lower joint of conductor pipe following the installation of an upper joint of conductor pipe would be highly undesirable, and would consume tremendous amounts of time and rig resources.

Apparatuses and methods to simplify the lifting, assembly, and installation of strings of conductor pipe would be well received in the industry. In particular, apparatuses and methods to assemble and install joints of conductor casing without requiring the installation and removal of lifting and handling eyes would be a significant benefit to the industry.

SUMMARY OF THE CLAIMED SUBJECT MATTER

In one aspect, the present disclosure relates to lifting elevator, the lifting elevator including a first elevator segment having a first plurality of slips, a second elevator segment having a second plurality of slips, and a hinge about which both the first elevator segment and the second elevator segment are rotatable with respect to each other, in which the first elevator segment and the second elevator segment each has a swept angle of about 180°, and in which each of the first plurality of slips and the second plurality of slips has a die configured to grip an external surface of a pipe.

According to another aspect, the present disclosure relates to a method, the method including opening a first elevator segment and a second elevator segment of a lifting elevator about a hinge connecting the first elevator segment and the second elevator segment, in which the first elevator segment and the second elevator segment each has a swept angle of about 180°, tilting the lifting elevator to a non-vertical position, receiving a non-vertical joint of pipe within the opened, tilted lifting elevator, closing the first elevator segment and the second elevator segment of the lifting elevator around the non-vertical joint of pipe, gripping the non-vertical joint of pipe with a plurality of slips of the lifting elevator, lifting the gripped, non-vertical joint of pipe to a vertical position using the lifting elevator, positioning the vertical joint of pipe atop a conductor string, attaching the vertical joint of pipe to the conductor string, and supporting the joint of pipe and the conductor string with the lifting elevator.

According to another aspect, the present disclosure relates to a lifting elevator including a first elevator segment having a first plurality of slips, a second elevator segment rotatably coupled to the first elevator segment, the second elevator segment having a second plurality of slips, a third elevator segment rotatably coupled to the first elevator segment, the third elevator segment having a third plurality of slips, a first hinge about which the first elevator segment and the second elevator segment are rotatable with respect to each other, and a second hinge about which the first elevator segment and the third elevator segment are rotatable with respect to each other, in which each of the first plurality of slips, the second plurality of slips, and the third plurality of slips has a die configured to grip an external surface of a pipe.

Other aspects and advantages of the disclosure will be apparent from the following description and the appended claims.

BRIEF DESCRIPTION OF DRAWINGS

Features of the present disclosure will become more apparent from the following description in conjunction with the accompanying drawings.

DETAILED DESCRIPTION

Apparatuses and methods disclosed herein relate to the assembly and installation of strings of large-diameter tubulars. While strings of conductor pipe are discussed in conjunction with the embodiments described below, it should be understood that various types (and sizes) of tubular items may be handled, assembled, and installed in accordance with the embodiments described below.

The following is directed to various exemplary embodiments of the disclosure. Although one or more of these embodiments may be preferred, the embodiments disclosed should not be interpreted, or otherwise used, as limiting the scope of the disclosure, including the claims. In addition, those having ordinary skill in the art will appreciate that the following description has broad application, and the discussion of any embodiment is meant only to be exemplary of that embodiment, and not intended to suggest that the scope of the disclosure, including the claims, is limited to that embodiment.

Certain terms are used throughout the following description and claims to refer to particular features or components. As those having ordinary skill in the art will appreciate, different persons may refer to the same feature or component by different names. This document does not intend to distinguish between components or features that differ in name but not function. The figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first component is coupled to a second component, that connection may be through a direct connection, or through an indirect connection via other components, devices, and connections. Further, the terms "axial" and "axially" generally mean along or parallel to a central or longitudinal axis, while the terms "radial" and "radially" generally mean perpendicular to a central longitudinal axis.

Figure 1A:
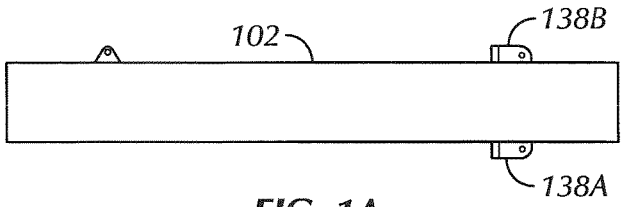
FIG. 1A is a schematic view drawing of a horizontal lifting apparatus in accordance with embodiments of the present disclosure.

Referring initially to FIG. 1A, a horizontal lifting apparatus is shown schematically lifting a horizontally-stored joint of conductor pipe 102. As shown, lifting apparatus includes a pair of lifting lugs 138A and 138B. In certain circumstances, it may be advantageous to lift joint of conductor pipe 102 at an angle (e.g., when required by available on rig floor, so those having ordinary skill in the art will appreciate that the relative positions of lifting lugs 138A, 138B may be varied to achieve the desired angle of joint of conductor pipe 102 as it is lifted.

Further, it should be understood that lifting lugs 138A, 138B may be constructed as continuous circular (or other) profiles.

Additionally, lifting rings 104A, 104B may be constructed as hinged and segmented rings such that they may be opened and closed laterally around the joint of conductor pipe 102 without needing to be slid over the ends. In particular, in cases where joints of conductor pipe 102 are laying directly on the floor of the rig or in the pipe rack, it may not be possible to slide rings 104A, 104B over the ends of layed pipe without lifting the conductor pipe 102 a sufficient amount to allow the thickness of lifting rings 104A, 104B thereunder. As such, segmented, openable, and closeable lifting rings 104A, 104B may allow the joint of conductor pipe 102 to be "grabbed" from above and lifted. Furthermore, the mechanisms of lifting rings 104A, 104B may be such that the segments of each ring 104A, 104B are tended to be closed as tension from lines 106A, 106B increases. Thus, for a joint of conductor pipe 102 laying on the floor, lifting rings 104A and 104B may be hingedly placed around the joint of pipe 102, but may not be able to fully close with pipe 102 laying on the floor. As lines 106A, 106B are pulled from point 108, rings 104A, 104B may be pulled fully closed as pipe 102 is lifted from the floor.

Figure 1B:
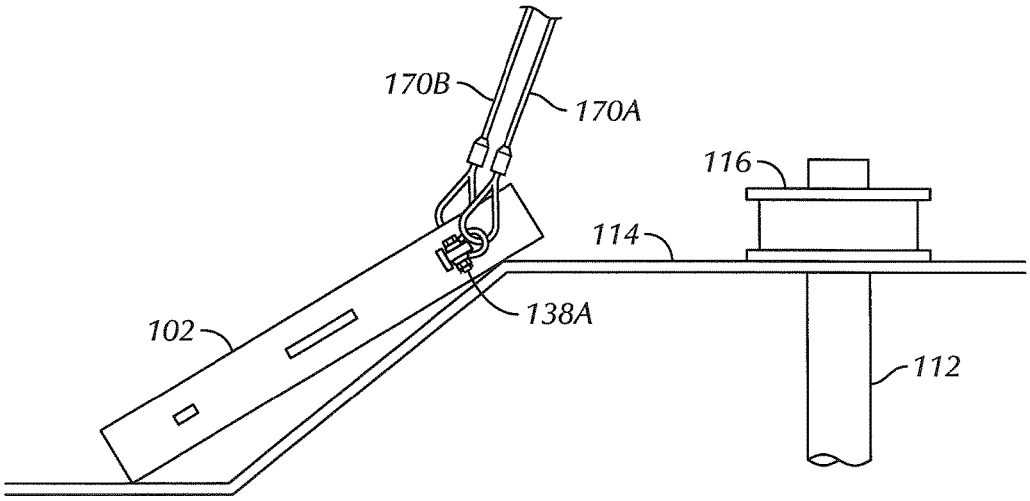
FIG. 1B is a schematic view drawing of a horizontal lifting apparatus in accordance with embodiments of the present disclosure.

Finally, while lifting lugs 138A, 138B are shown schematically, it should be understood that various lifting methods and apparatus, for example, but not limited to, lifting slings, chains, and other rigging may be used in place of the simple schematic view shown in FIG. 1A. Furthermore, depending on location and the resources available, the horizontal lifting of joint of conductor pipe 102 from a pipe rack or the rig floor and next to be run may be performed by an auxiliary crane, a separate lifting apparatus, or by the drilling rig's draw works. After a "to be added" joint of conductor pipe 102 is disposed from its position in the pipe rack (or other location on the rig), it must be rotated to vertical before it may be assembled to the remainder of the string of conductor pipe 112. FIG. 1B shows a schematic view of a horizontal lifting apparatus having bails 170A and 170B. As shown, the bails 170A and 170B may engage with lifting lug 138A and lifting lug 138B shown in FIG. 1A to lift the joint of conductor pipe 102.

Figure 2:
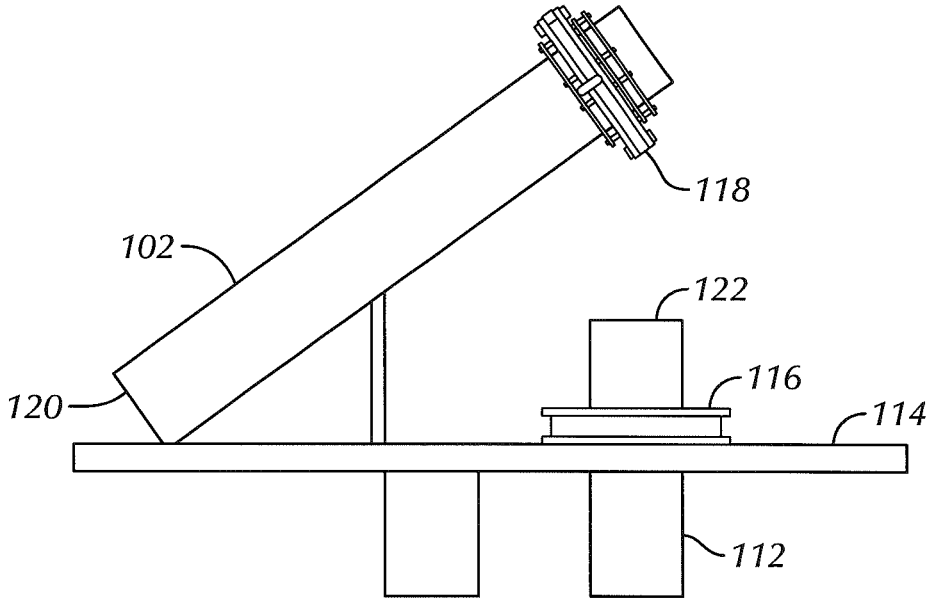
FIG. 2 is a schematic view drawing of a joint of conductor pipe being raised from a horizontal position to a vertical position in accordance with embodiments of the present disclosure.
Figure 3:
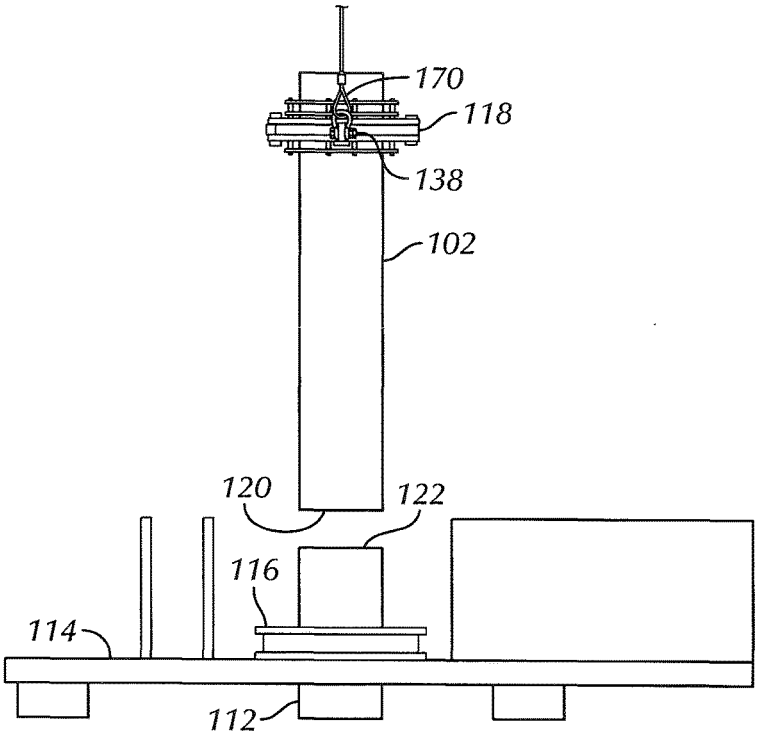
FIG. 3 is a schematic view drawing of the joint of conductor pipe of FIG. 2 in the vertical position in accordance with embodiments of the present disclosure.

Referring now to FIGS. 2 and 3, the rotation and assembly of joint of conductor pipe 102 to the remainder of a string of conductor pipe 112 is shown schematically. As depicted, the drilling rig includes a rig floor 114 and a spider 116 holding string of conductor pipe 112 in the well. A segmented elevator 118 grasps a first end of the joint of conductor pipe 102 to be added to string 112, such that joint of conductor pipe 102 may be tilted from a non-vertical position, e.g., the horizontal position in FIG. 2A, or an intermediate position, e.g., as shown in FIG. 2, and to a vertical (FIG. 3) position. As will be described below in further detail, elevator 118 includes slips to grip the outer profile of joint of conductor pipe 102 and lifting lugs to allow elevator 118 to be lifted from a horizontal position to a vertical position so that lower end 120 of joint of conductor pipe 102 may be connected (e.g., threaded, welded, etc.) to the upper end 122 of the string of conductor pipe 112.

Figure 4:
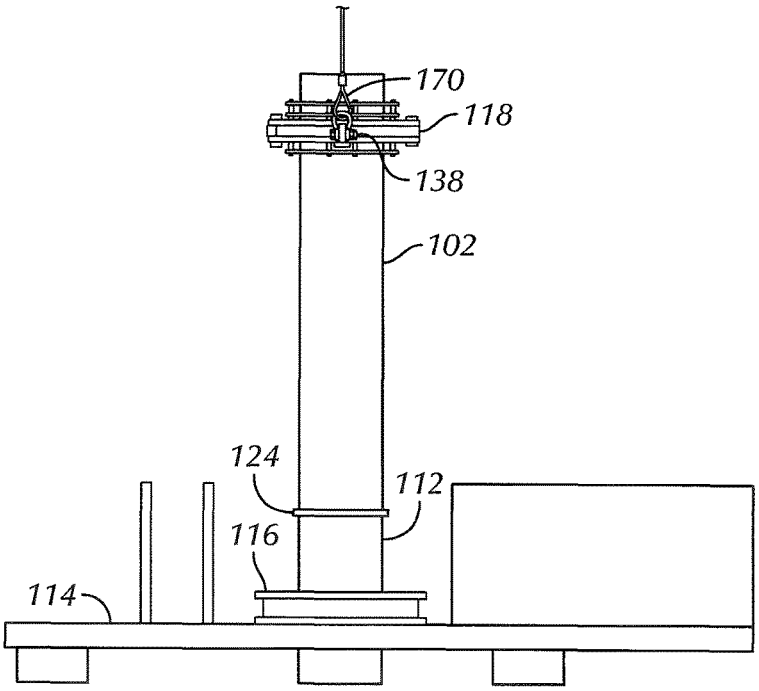
FIG. 4 is a schematic view drawing of the joint of conductor pipe of FIGS. 2 and 3 being connected to a string of conductor pipe in accordance with embodiments of the present disclosure.

Referring now to FIG. 4 the joint of conductor pipe 102 to be added is shown atop string of conductor pipe 112 where it may be connected in place at 124. Prior to completion of the joining of the joint of conductor pipe 102 to the conductor pipe string 112, spider 116 supports the weight of pipe string 112 and elevator 118 supports the weight of joint of conductor pipe 102. With joint 102 securely connected to (and now integrally part of) conductor pipe string 112, the slips of spider 116 may be released so that the entire weight of the conductor pipe string 112 (including add on joint 102) may be carried by elevator 118.

Figure 5:
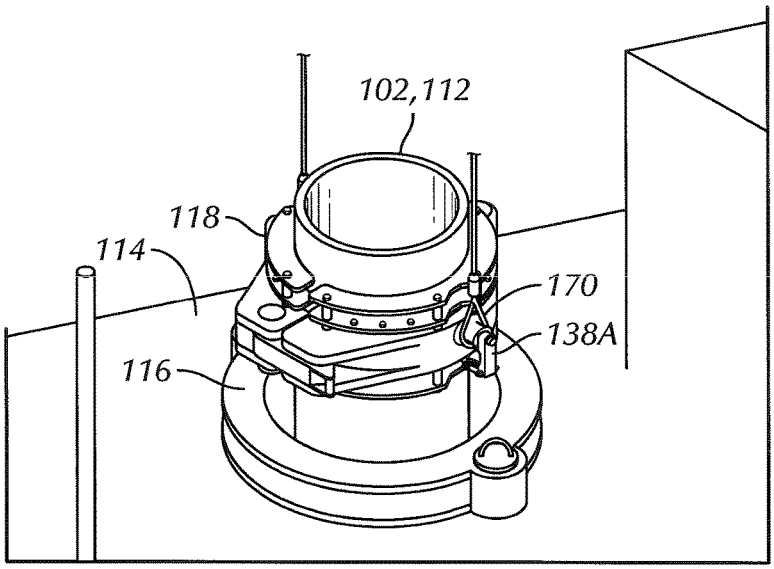
FIG. 5 is a schematic view drawing of the joint of conductor pipe of FIGS. 2-4 engaged into the wellbore along with the string of conductor pipe in accordance with embodiments of the present disclosure.
Figure 6:
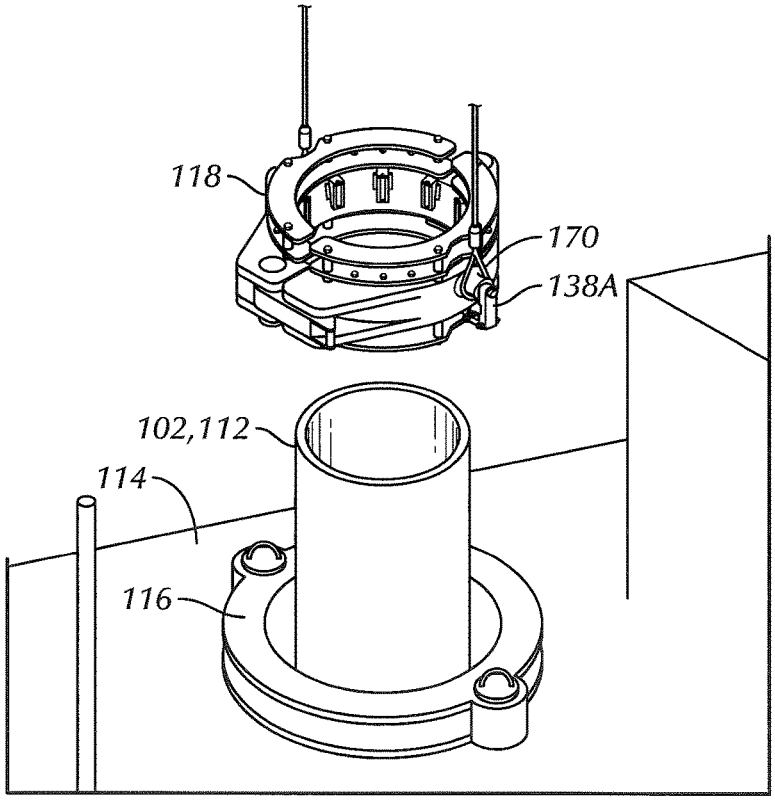
FIG. 6 is a schematic view drawing of an elevator of FIGS. 2-5 being removed from the string of conductor pipe in accordance with embodiments of the present disclosure.

Referring now to FIG. 5, conductor pipe string 112 may be lowered below the rig floor from its full height (FIG. 4) to it's new, lowered height such that upper end of joint 102 of conductor string 112 is adjacent and above rig floor 114. In this new position, the slips of spider 116 may be re-engaged so that spider 116 again holds the entire weight of string of conductor pipe 112. Referring briefly now to FIG. 6, the slips of elevator 118 may be de-activated so that elevator 118 may be lifted, e.g., by the rig's draw works, and removed from upper end of added on joint 102 of conductor string 112 so that the process may be repeated with a new joint of conductor pipe to be added.

Figure 7:
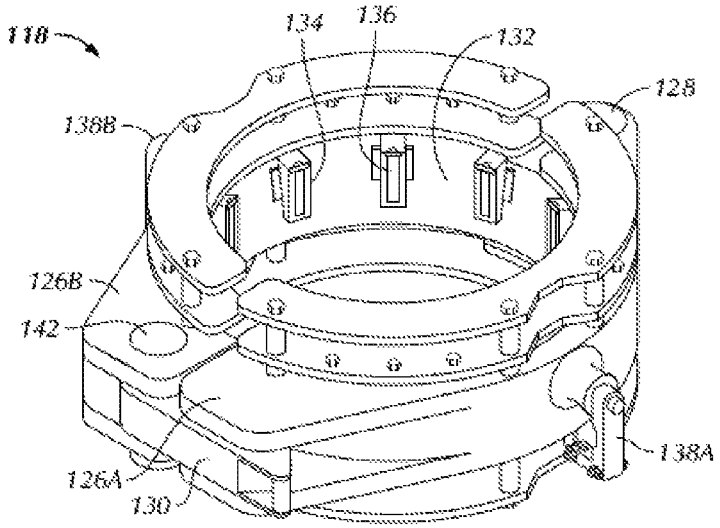
FIG. 7 is a detailed perspective view drawing of the elevator of FIGS. 2-6 in accordance with embodiments of the present disclosure.

Referring now to FIG. 7, a more detailed view of the elevator 118 depicted in FIGS. 2-6 is shown. Elevator 118 is shown constructed as a segmented ring comprising a first half 126A, a second half 126B, a hinge, 128, and a latch 130. Latch 130 may be constructed as a pin, a hinge, or any other mechanism through which a connection between half 126A and half 126B may be coupled and de-coupled. While elevator 118 is shown segmented into two halves 126A, 126B, those having ordinary skill will appreciate that more than two segments may be used. Furthermore, it should be understood that the segments of elevator 118 need not be equal in size or angle swept. For example, in one embodiment, segmented elevator 118 may comprise three segments, two segments having 150° swept angles, and a third (e.g., non-pivoting) segment having an angle of 60°.

Furthermore, when in the closed position (shown), the inner profile 132 of the halves 126A, 126B of the segmented ring is generally circular in shape and includes a plurality of slip assemblies 134 spaced at generally equal radial positions (at a common axial location) thereabout. As shown, each slip assembly 134 includes a die, e.g., gripping surface, 136 configured to "bite" into contact with joints of conductor pipe (e.g., 102) and assembled conductor pipe string 112. Those having ordinary skill in the art will appreciate that slip assemblies 134 may be designed on inclined planes such that the grip diameter (i.e., the average inner diameter among the slip assemblies 134) of the slip assemblies 134 decreases as the slip assemblies are thrust downward. In one embodiment, a single "timing ring" axially actuates all slip assemblies 134 simultaneously so that the grip diameter of the elevator 118 is relatively consistent. The timing ring may be thrust hydraulically, pneumatically, mechanically, or through any type of actuator known to those having ordinary skill in the art. Thus, as slip assemblies 134 (and dies 136) are activated to engage the outer profile of conductor pipe string 112, additional downward thrusting of the conductor string 112 (e.g., from the weight of the string 112) acts to increase the amount of "bite" dies 136 exhibit into conductor pipe string 112. Those having ordinary skill in the art will appreciate that slip assemblies 134 of elevator 118 may be activated and actuated using various methods and mechanisms available including, but not limited to, electrical activation, hydraulic activation, pneumatic activation, and mechanical activation.

Figure 8A:
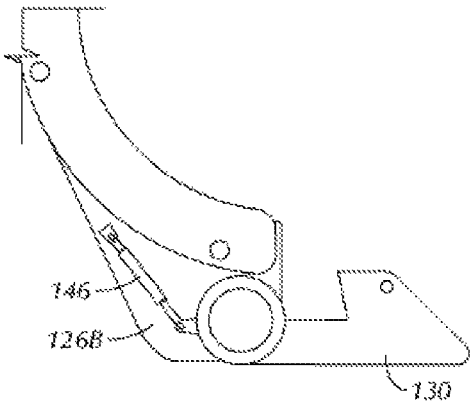
FIG. 8A is a schematic view of a first embodiment of an actuated latch mechanism of the elevator of FIG. 8.
Figure 8B:
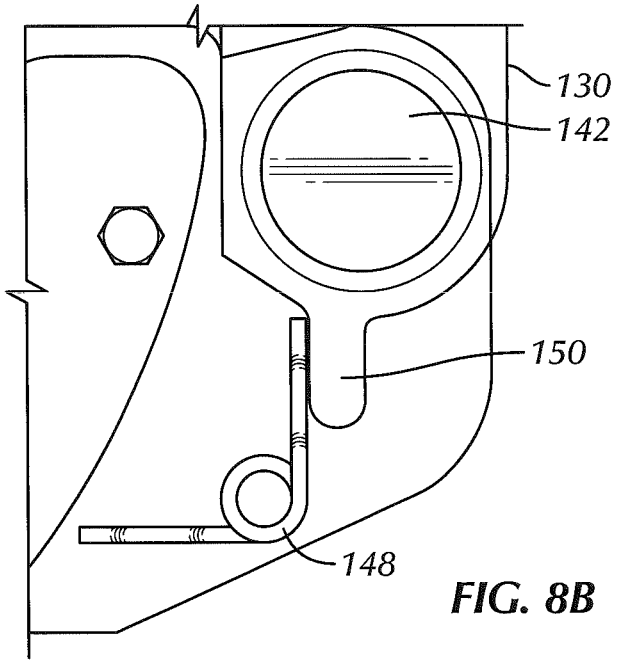
FIG. 8B is a schematic view of a second embodiment of an actuated latch mechanism of the elevator of FIG. 8.
Figure 8:
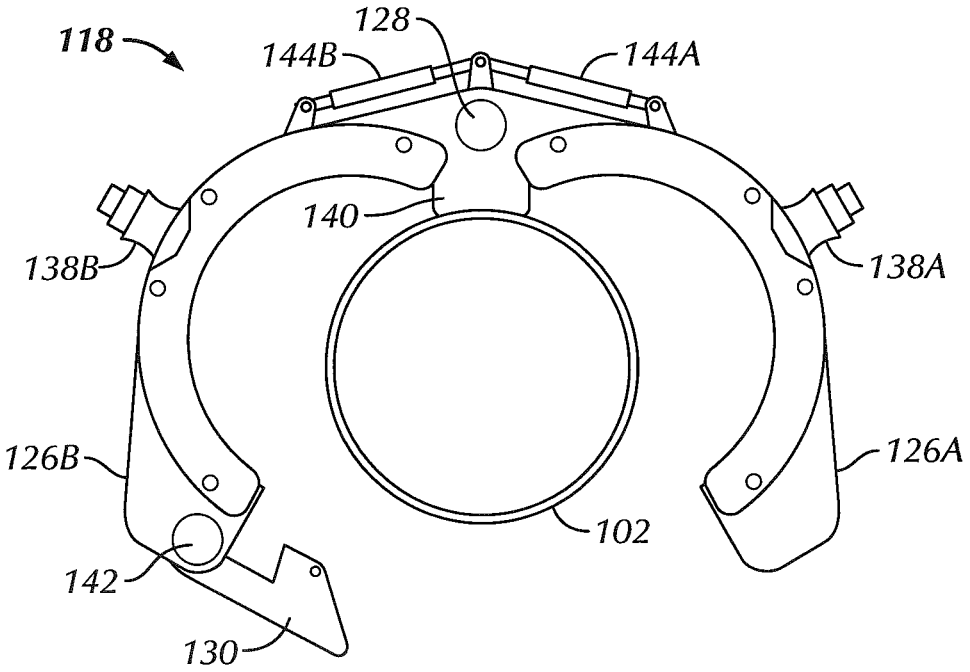
FIG. 8 is a schematic view of the elevator of FIG. 7 in an open position about to engage a joint of conductor pipe in accordance with embodiments of the present disclosure.
Figure 11:
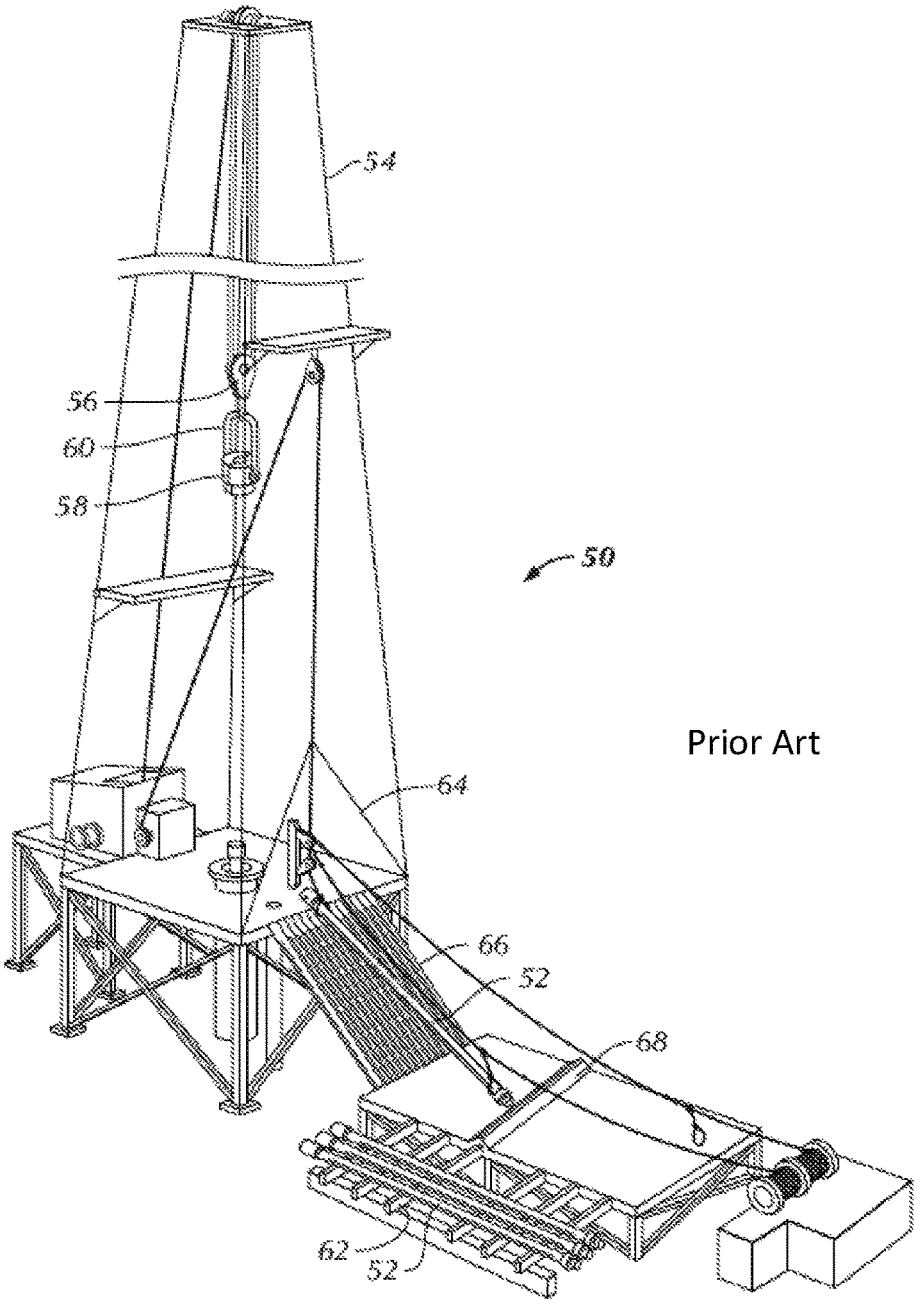
Prior Art FIG. 11
FIG. 11 is a prior-art schematic drawing of a typical drilling rig.

Referring now to FIG. 8, elevator 118 is shown in an open position as it is lowered over a horizontally-laying joint of conductor pipe 102. A lifting sling (not shown) or an alternative form of rigging may attach to elevator at lifting lugs 138A and 138B. Such a lifting apparatus may include swivels or other devices so that elevator 118 may switch from vertical position (e.g., FIGS. 3 and 4) to horizontal position (FIG. 8) with relative ease. In certain embodiments, elevator 118 may be suspended directly from the hook (e.g., 60 of FIG. 11) of a traveling block (e.g., 56 of FIG. 11) of the rig's draw works. As shown, elevator 118 is lowered about horizontal joint of conductor pipe 102 such that a back stop 140 of elevator abuts the top of joint of conductor pipe 102. Optionally, a pair of cylinders 144A, 144B may be used to open and close halves 126A, 126B of elevator 118. Similarly, referring briefly to FIG. 8A, a cylinder 146 may be used to open and close latch 130 between halves 126B and 126A. While hydraulic cylinders are depicted in FIGS. 8 and 8A as 144A, 144B, and 146, it should be understood that pneumatic cylinders, mechanical ball screws, or any other type of powered actuator may be used. Alternatively still, referring to FIG. 8B, a torsion spring 148 in conjunction with an upset portion 150 of latch 130 may be used to bias latch 130 in a closed or open direction.

Figure 9:
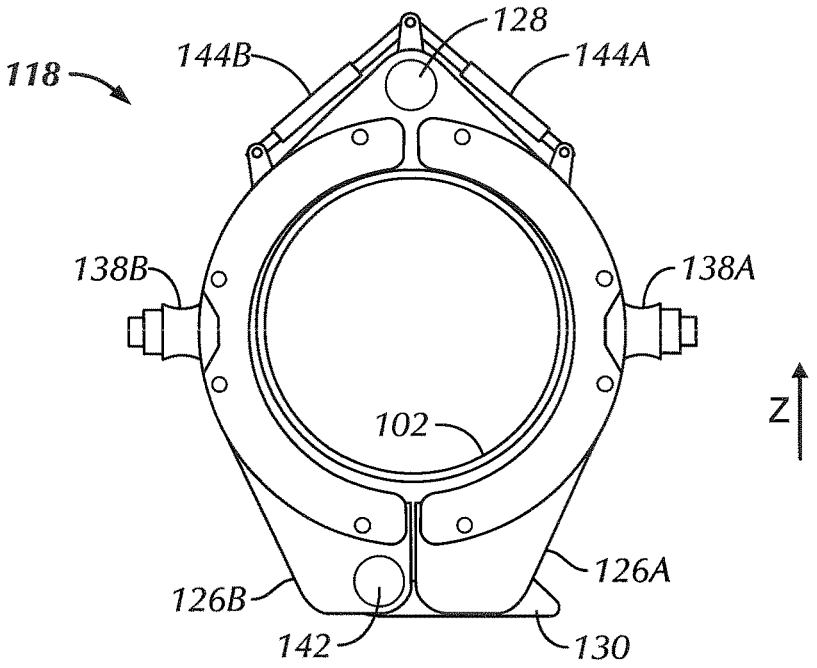
FIG. 9 is a schematic view of the elevator of FIG. 8 in a closed position around the joint of conductor pipe in accordance with embodiments of the present disclosure.

Referring now to FIG. 9, the two halves 126A, 126B of elevator 118 may rotate about hinge 128 to the closed position and latch 130 may rotate about pin 142 to lockably engage half 126B with half 126A. Because joint of conductor pipe 102 is non-vertical and elevated (e.g., with lifting apparatus 100 of FIG. 1A), two halves 126A, 126B of elevator 118 may rotate about hinge 128 to the closed position, e.g., encircling the joint 102. Depicted latch 130 has sufficient clearance to reach around the bottom of joint of conductor pipe 102 and engage with half 126A of segmented ring of elevator 118. With latch 130 secured closed, elevator may be lifted up (in direction Z) without concern that halves 126A, 126B will separate and release joint of conductor pipe 102. As such, slips 134 may be activated to secure (and center) joint of conductor pipe 102 within the inner profile of elevator 118. In alternative embodiments, latch 130 may function without pivot pin 142 and may have a lower profile. It should be understood that embodiments disclosed herein should not be limited to a particular latch mechanism. Furthermore, it should be understood that latch mechanism (e.g., 130) may not be necessary at all, for example, powered actuators used to open and close halves 126A, 126B of elevator 118 may be used to keep halves 126A, 126B together when lifting joint of conductor pipe 102.

Figure 10:
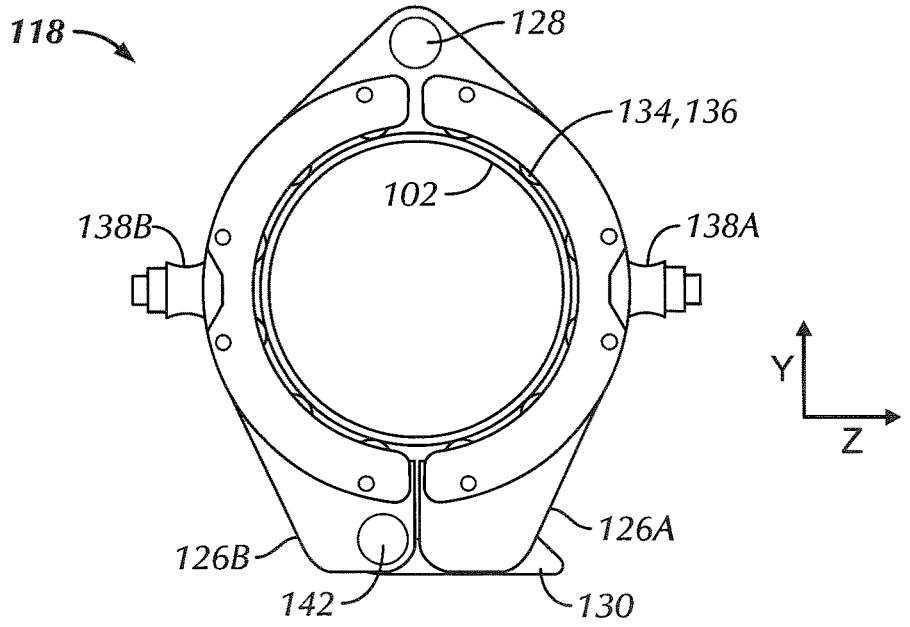
FIG. 10 is a schematic view of the elevator of FIG. 9 in a closed position with slips engaged into the joint of conductor pipe in accordance with embodiments of the present disclosure.

Referring now to FIG. 10, a top-view schematic of elevator 118 is shown with slips 134 activated into the engaged position and securing joint of conductor pipe 102 within the inner profile of segmented ring elevator 118. As such, elevator may be used to raise and lower the joint of conductor pipe 102 in the vertical position, the horizontal position, and all positions in-between.

Figure 12A:
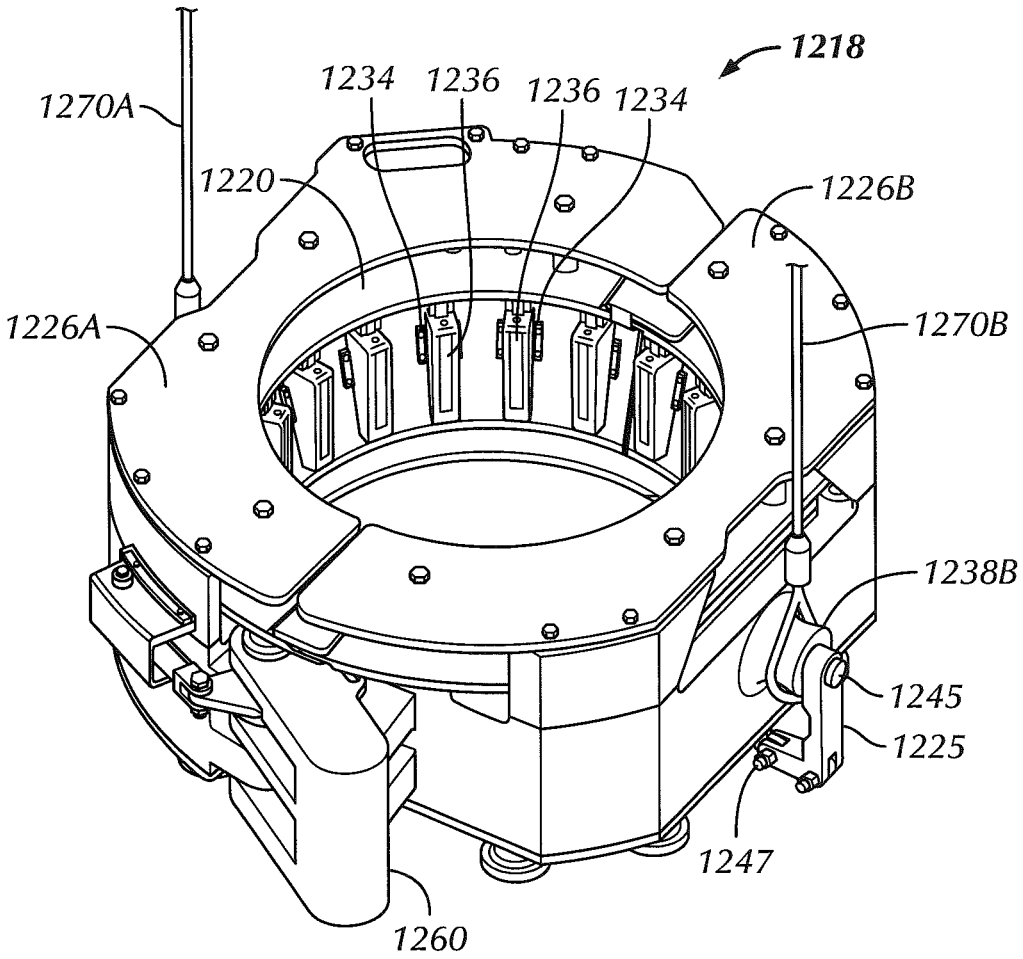
FIGS. 12A and 12B show perspective views of a lifting apparatus in accordance with embodiments of the present disclosure.
Figure 12B:
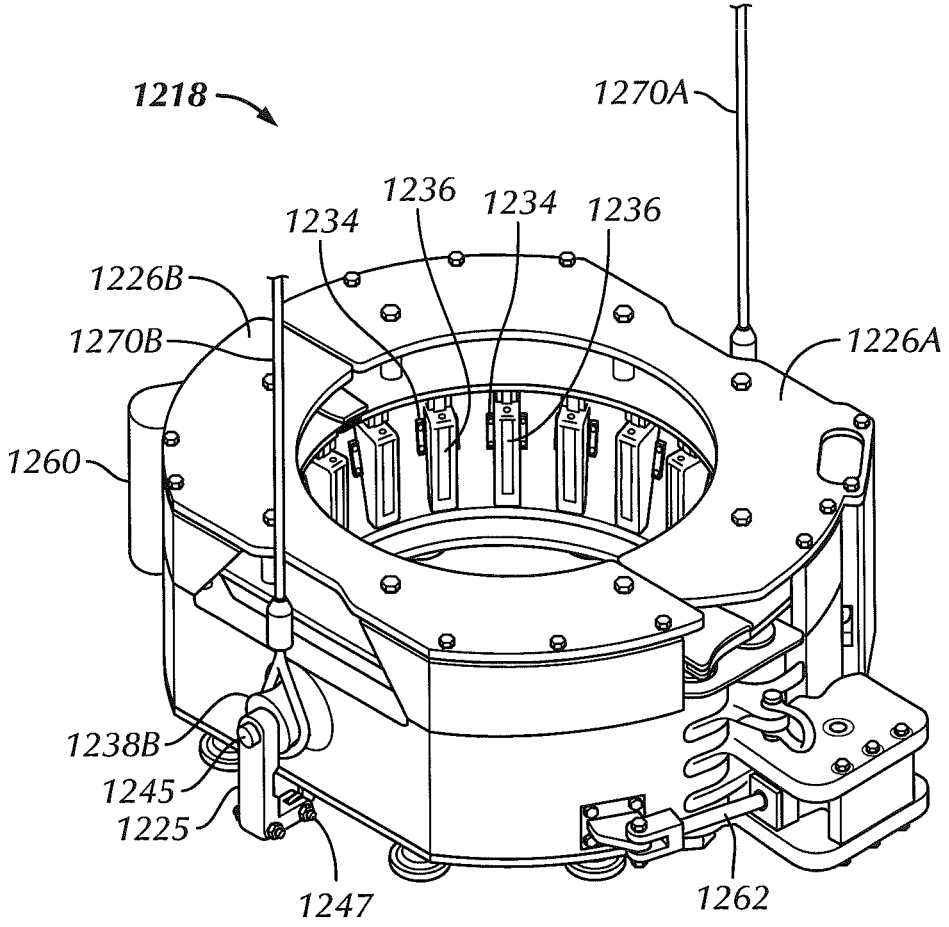

Referring now to FIGS. 12A and 12B, perspective views of a lifting apparatus in accordance with embodiments of the present disclosure are shown. As shown, the lifting elevator 1218 includes a first elevator segment 1226A rotatably coupled to a second elevator segment 1226B. In one or more embodiments, a cylinder 1262 may be used to open and close the first elevator segment 1226A relative to the second elevator segment 1226B of the lifting elevator 1218, or vice versa.

Further, in one or more embodiments, the lifting elevator 1218 may include a pair of lifting lugs. For example, as shown in FIGS. 12A and 12B, a second lifting lug 1238B is coupled to the second elevator segment 1226B. Similarly, a first lifting lug (not shown) may be coupled to the first elevator segment 1226A such that, in one or more embodiments, a lifting sling (not shown), or a first bail 1270A and a second bail 1270B, or an alternative form of rigging may attach to elevator at the first lifting lug and the second lifting lug 123B. For example, the first lifting lug and the second lifting lug 1238B may be positioned on the first elevator segment 1226A and the second elevator segment 1226B, respectively, similarly to that of lifting lugs 138A and 138B shown in FIG. 8. A lifting apparatus such as a lifting sling may include swivels or other devices so that lifting elevator 1218 may switch from a vertical position (e.g., FIGS. 3 and 4) to a horizontal position (FIG. 8). In one or more embodiments, the first lifting lug and the second lifting lug 1238B may be removably coupled to the second elevator segment 1226B.

Further, in one or more embodiments, one or more slings or bail retainers 1225 may be removably coupled to the lifting elevator 1218. For example, as shown, the bail retainer 1225 is coupled to the second elevator segment 1226B through the lifting lug 1238 and by way of a first bolt 1245 and a second bolt 1247. Specifically, in one or more embodiments, each of the bail retainer 1225 coupled to each of the first lifting lug and the second lifting lug may be coupled to the first elevator segment 1226A and the second elevator segment 1226B, respectively, by way of a connecting mechanism, such as a bolt, screw, and/or nut combination, or by way of any other connecting means known in the art. As such, in one or more embodiments, the bail retainer 1225 may be removably coupled to the first elevator segment 1226A and the second elevator segment 1226B, respectively, e.g., through the first lifting lug and the second lifting lug, without having to weld the bail retainer 1225 onto the lifting elevator 1218. Moreover, in one or more embodiments, the first lifting lug and the second lifting lug may formed onto the first elevator segment 1226A and the second elevator segment 1226B, respectively, without having to weld the lugs onto the lifting elevator 1218.

Furthermore, when the elevator 1218 is in the closed position, i.e., as shown in FIGS. 12A and 12B, an inner profile of the first elevator segment 1226A and the second elevator segment 1226B is generally circular in shape and includes a plurality of slip assemblies 1234 spaced at generally equal radial positions (at a common axial location) thereabout. As shown, the lifting elevator 1218 includes a latch 1260 that may be used to secure the first elevator segment 1226A and the second elevator segment 1226B in the closed position. Moreover, as shown, each slip assembly 1234 includes a die 1236, e.g., a gripping surface, configured to "bite" into contact with joints of conductor pipe (e.g., pipe 102 shown in FIG. 8 or pipe 1402 shown in FIG. 14) and an assembled conductor pipe string (e.g., the assembled conductor pipe string 112 shown in FIG. 6). Those having ordinary skill in the art will appreciate that slip assemblies 1234 may be designed on inclined planes such that the grip diameter (i.e., the average inner diameter among the slip assemblies 1234) of the slip assemblies 1234 decreases as the slip assemblies are thrust downward.

In one embodiment, a timing ring 1220 may axially actuate all slip assemblies 1234 simultaneously so that the grip diameter of the elevator 1218 is relatively consistent. The timing ring 1220 may include bifurcated segments coupled to each of the first elevator segment 1226A and the second elevator 1226B, respectively. In one or more embodiments, the timing ring 1220 may contact, either directly or indirectly, the slip assemblies 1234 and may be used to actuate and deactuate the slip assemblies 1234 of the lifting elevator 1218 together when the lifting elevator 1218 is in the closed position. The timing ring 1220 may be thrust hydraulically, pneumatically, mechanically, or through any type of actuator known to those having ordinary skill in the art. Thus, as slip assemblies 1234 (and dies 1236) are activated to engage the outer profile of conductor pipe string, additional downward thrusting of the conductor string (e.g., from the weight of the conductor string) acts to increase the amount of "bite" dies 1236 exhibit into conductor pipe string. Those having ordinary skill in the art will appreciate that slip assemblies 1234 of elevator 1218 may be activated and actuated using various methods and mechanisms available including, but not limited to, electrical activation, hydraulic activation, pneumatic activation, and mechanical activation. In one or more embodiments, actuators may be disposed in each of the first elevator segment 1226A and the second elevator segment 1226B and may be used to actuate the timing ring 1220.

Figure 13:
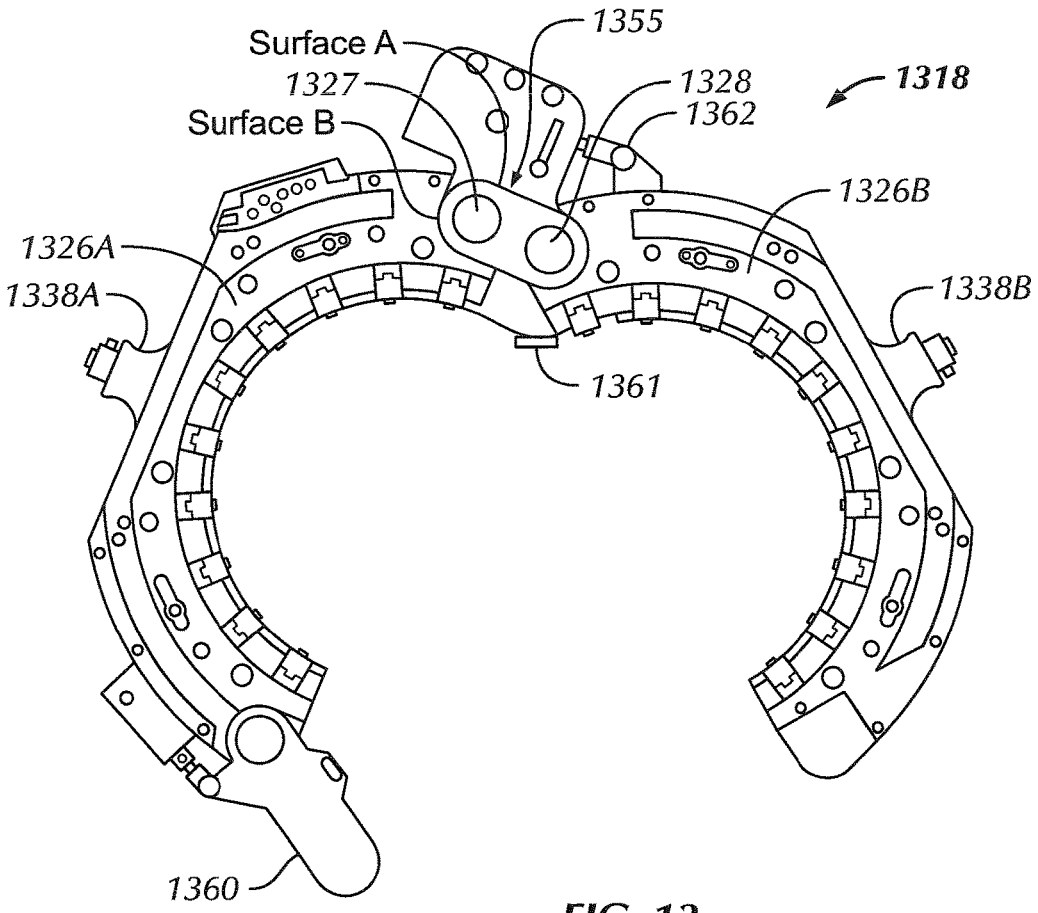
FIG. 13 is a top view of a lifting apparatus in accordance with embodiments of the present disclosure.

Referring now to FIG. 13, a top view of a lifting apparatus in accordance with embodiments of the present disclosure is shown. As shown, the lifting elevator 1318 includes a first elevator segment 1326A rotatably coupled to a second elevator segment 1326B. Further, the lifting elevator 1318 includes a hinge assembly that includes a link 1355 that is pin connected by a first pin to the first elevator segment, the link including a fixed planar surface that mates with a mating fixed planar surface of the first elevator segment such that the link is rotationally fixed to the first elevator segment. For example, the link may include a surface A and a surface B, the surface A being perpendicular to the surface B. In one or more embodiments, the surface B of the link 1355 contacts a mating surface of the first elevator segment 1326A.

Furthermore, as shown, the hinge assembly of the lifting elevator 1318 includes a first pin 1327 extending through the link 1355 and coupling the link 1355 to the first elevator segment 1326A, and a second pin 1328 extending through the link 1355 and coupling the link 1355 to the second elevator segment 1326B. In one or more embodiments, the second pin 1328 may be functionally equivalent to the hinge 128 discussed above with reference to FIGS. 7, 8, 9, and 10. In one or more embodiments, the contact between the surface B of the link 1355 and the mating surface of the first elevator segment 1326A prohibits relative rotation between the link 1355 and the first elevator segment 1326A, and the second elevator segment 1326B rotates about the second pin 1328 relative to the link 1355 and relative to the first elevator segment 1326A. In one or more embodiments, the second elevator segment 1326B may rotate about the second pin 1328 relative to the link 1355 and relative to the first elevator segment 1326A by way of a cylinder 1362.

Moreover, as shown in FIG. 13, the lifting elevator 1318 may include a pair of lifting lugs 1338A and 1338B coupled to the first elevator segment 1326A and the second elevator segment 1326B, respectively. In one or more embodiments, a lifting sling or bail (not shown) or an alternative form of rigging may attach to elevator 1318 at the first lifting lug 1338A and the second lifting lug 1338B. A lifting apparatus such as a lifting sling or bail may include swivels or other devices so that lifting elevator 1318 may switch from a vertical position (e.g., FIGS. 3 and 4) to a horizontal position (FIG. 8).

Further, as shown, the lifting elevator 1318 may include a latch 1360 and a backstop 1361. In one or more embodiments, the latch 1360 may be coupled to either the first elevator segment 1326A or the second elevator segment 1326B and may be used to lock the lifting elevator 1318 in the closed position to secure a joint of pipe (e.g., the joint of pipe 1402 shown in FIG. 14) within the lifting elevator 1318. In one or more embodiments, the backstop 1361 may be coupled to the first elevator segment 1326A and/or the second elevator segment 1326B and may be configured to abut the joint of pipe when the joint of pipe is disposed within the lifting elevator 1318. In one or more embodiments, the backstop 1361 may be a non-movable backstop disposed between the first elevator segment 1326A and the second elevator segment 1326B and may be configured to abut a joint of pipe (e.g., the joint of pipe 1402 shown in FIG. 14) when the joint of pipe is disposed within the lifting elevator 1318.

Figure 14:
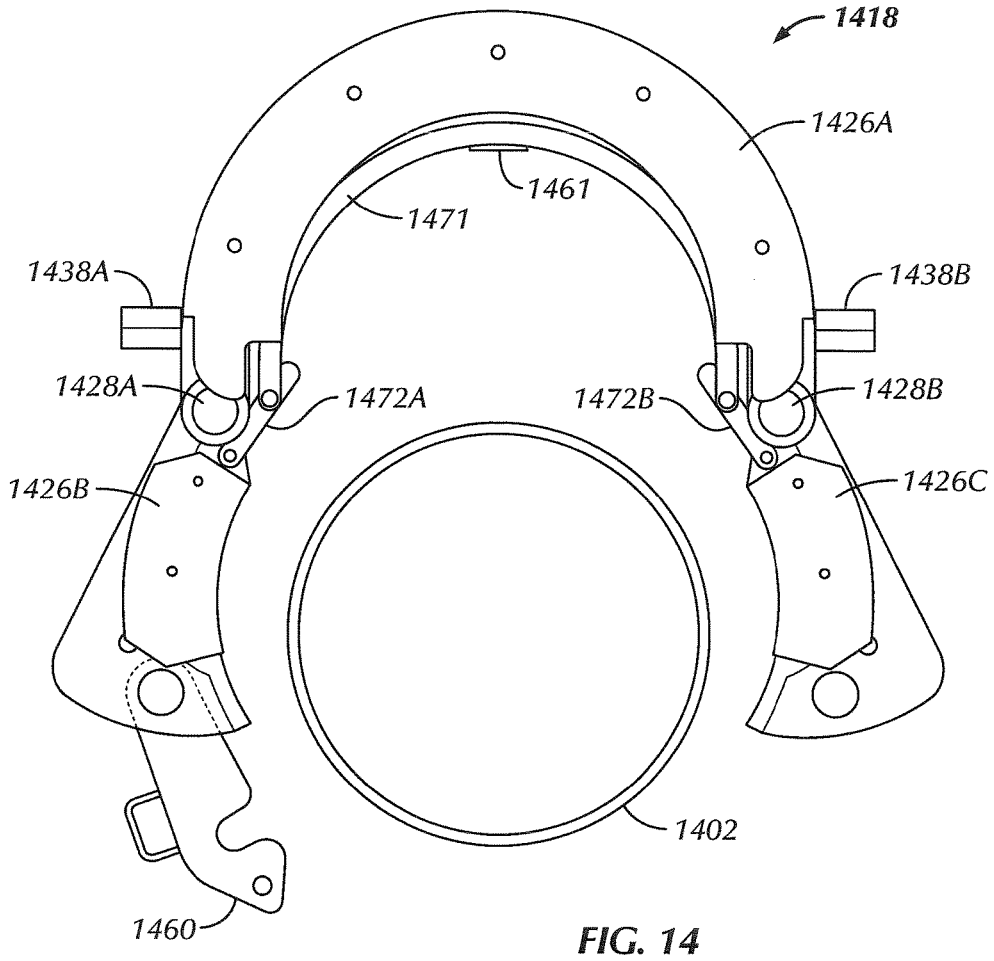
FIG. 14 is a top view of a lifting apparatus in accordance with embodiments of the present disclosure.

Referring now to FIG. 14, a top view of a lifting apparatus in accordance with embodiments of the present disclosure is shown. As shown, the lifting elevator 1418 includes a first elevator segment 1426A, a second elevator segment 1426B rotatably coupled to the first elevator segment 1426A, and a third elevator 1426C segment rotatably coupled to the first elevator segment 1426A. Further, as shown, the lifting elevator 1418 includes a first hinge 1428A about which the first elevator segment 1426A and the second elevator segment 1426B are rotatable with respect to each other, and a second hinge 1428B about which the first elevator segment 1426A and the third elevator segment 1426C are rotatable with respect to each other. Further, in one or more embodiments, each of the first elevator segment 1426A, the second elevator segment 1426B, and the third elevator segment 1426C may include a plurality of slips, and each of the plurality of slips (e.g., the slip assemblies 1234 shown in FIGS. 12A and 12B) may include a die (e.g., the dies 1236 shown in FIGS. 12A and 12B) configured to grip an external surface of a joint of pipe 1402. Moreover, as shown, lifting elevator 1418 may include a backstop 1461 coupled to a semi-circular actuator ring 1471. In one or more embodiments, the backstop 1461 may be disposed on the semi-circular actuator ring 1471 and may be configured to abut the joint of pipe 1402 when the joint of pipe 1402 is disposed within the lifting elevator 1418. One or more embodiments may also include a latch 1460, which may be coupled to either the second elevator segment 1426B or the third elevator segment 1426C. In one or more embodiments, the latch 1460 may be used to lock the lifting elevator 1418 in the closed position to secure the joint of pipe 1402 within the lifting elevator 1418.

Further, in one or more embodiments, the first elevator segment 1426A of the lifting elevator 1418 has a swept angle of about 180°, and each of the second elevator segment 1426B and the third elevator segment 1426C has a swept angle of about 90°. Moreover, in one or more embodiments, a first lifting lug 1438A and a second lifting lug 1438B may be formed on the first elevator segment 1426A and may be used to lift the lifting elevator 1418 and may bear the weight of the lifting elevator 1418 as well as the weight of the joint of pipe 1402 and a conductor string that may include the joint of pipe 1402.

Moreover, in one or more embodiments, the semi-circular actuator ring 1471 of the lifting elevator 1418 may include a first segment link closure 1472A and a second segment link closure 1472B coupled thereto. In one or more embodiments, the first segment link closure 1472A may also be coupled to the second elevator segment 1426B, and the second segment link closure 1472B may also be coupled to the third elevator segment 1426C. As such, once the lifting elevator 1418 is lowered over a length of horizontally oriented pipe, the semi-circular actuator ring 1471 may be pushed towards a throat of the elevator, and the first segment link closure 1472A and the second segment link closure 1472B may pull the second elevator segment 1426B and the third elevator segment 1426C, respectively, into the closed position.

Figure 15:
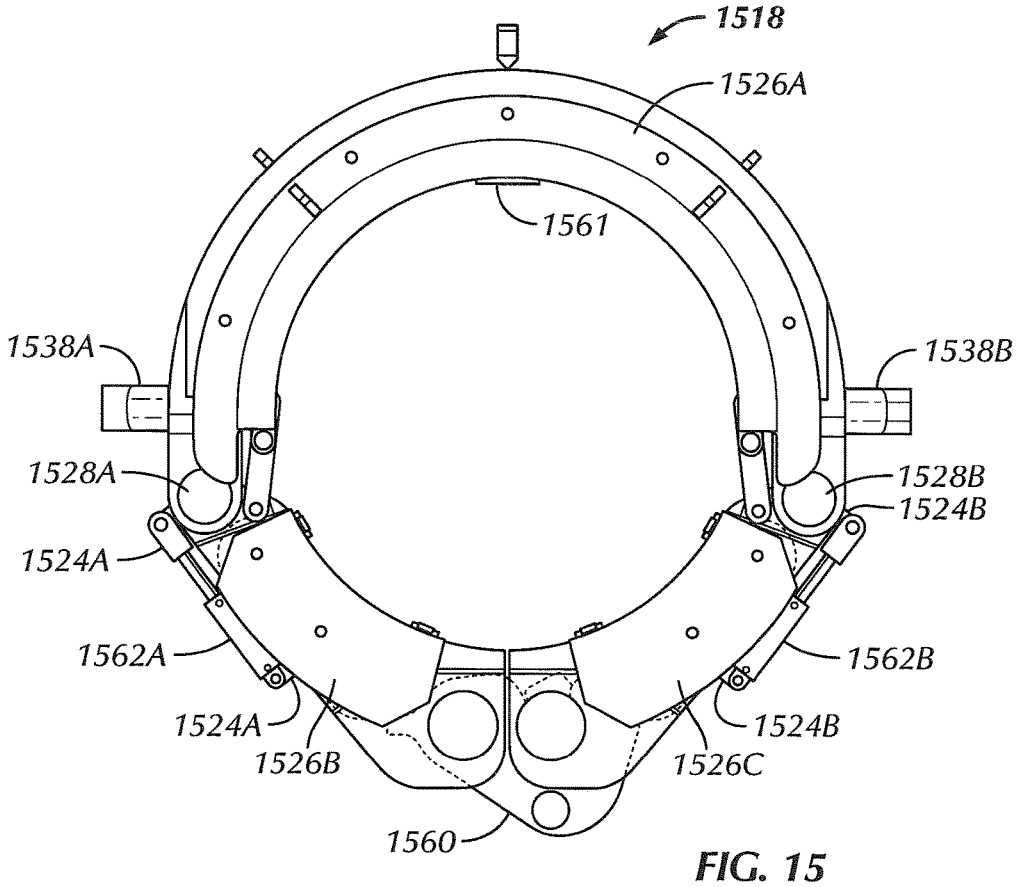
FIG. 15 is a top view of a lifting apparatus in accordance with embodiments of the present disclosure.

Referring now to FIG. 15, a top view of a lifting apparatus in accordance with embodiments of the present disclosure is shown. As shown, the lifting elevator 1518 includes a first elevator segment 1526A, a second elevator segment 1526B rotatably coupled to the first elevator segment 1526A, and a third elevator 1526C segment rotatably coupled to the first elevator segment 1526A. Further, as shown, the lifting elevator 1518 includes a first hinge 1528A about which the first elevator segment 1526A and the second elevator segment 1526B are rotatable with respect to each other, and a second hinge 1528B about which the first elevator segment 1526A and the third elevator segment 1526C are rotatable with respect to each other. Moreover, as shown, lifting elevator 1518 may include a backstop 1561 coupled to a semi-circular actuator ring (not shown). In one or more embodiments, the backstop 1561 may be disposed on the semi-circular actuator ring and may be configured to abut the joint of pipe 1502 when the joint of pipe 1502 is disposed within the lifting elevator 1518. One or more embodiments may also include a latch 1560, which may be coupled to either the second elevator segment 1526B or the third elevator segment 1526C. In one or more embodiments, the latch 1560 may be used to lock the lifting elevator 1518 in the closed position to secure the joint of pipe 1502 within the lifting elevator 1518.

Further, in one or more embodiments, the first elevator segment 1526A of the lifting elevator 1518 has a swept angle of about 180°, and each of the second elevator segment 1526B and the third elevator segment 1526C has a swept angle of about 90°. Moreover, in one or more embodiments, a first lifting lug 1538A and a second lifting lug 1538B may be formed on the first elevator segment 1526A and may be used to lift the lifting elevator 1518 and may bear the weight of the lifting elevator 1518 as well as the weight of the joint of pipe 1502 and a conductor string that may include the joint of pipe 1502.

Moreover, in one or more embodiments, the lifting elevator 1518 may include a first actuator 1562A coupled to the first elevator segment 1526A and the second elevator segment 1526B, and a second actuator 1562B coupled to the first elevator segment 1526A and the third elevator segment 1526C. In one or more embodiments, the first actuator 1562A may be coupled to the first elevator segment 1526A and the second elevator segment 1526B via pad eyes 1524A, and the second actuator 1562B may be coupled to the first elevator segment 1526A and the third elevator segment 1526C via pad eyes 1524B. In one or more embodiments, the first actuator 1562A and the second actuator 1562B may be used to move the second elevator segment 1526B and the third elevator segment 1526B, respectively, between an open position (as shown in FIGS. 13 and 14) and a closed position as shown. In one or more embodiments, the first actuator 1562A and the second actuator 1562B may be hydraulic, pneumatic, mechanic, or any type of actuator known to those having ordinary skill in the art.

Figure 16:
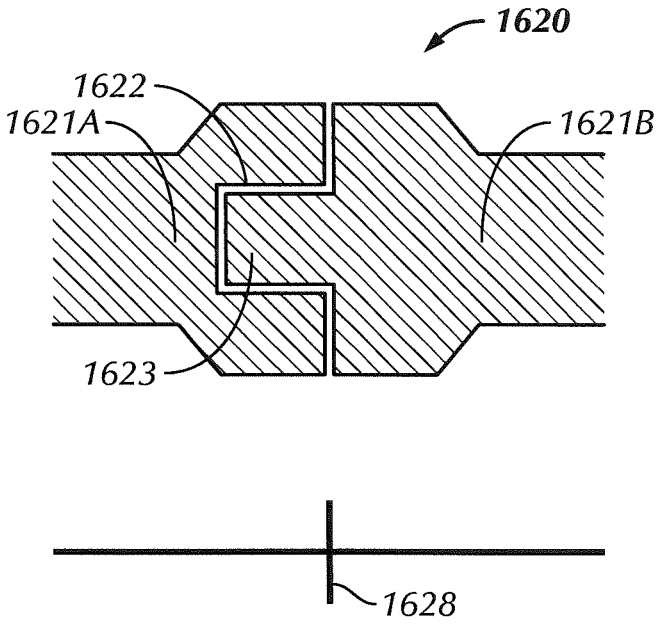
FIG. 16 is a cross-sectional side view of a timing ring in accordance with embodiments of the present disclosure.

Referring now to FIG. 16, a cross-sectional side view of a timing ring 1620 in accordance with embodiments disclosed herein is shown. In one or more embodiments, the timing ring 1620 may be include bifurcated segments coupled to each of a first elevator segment and the second elevator (e.g., the first elevator segment 1226A and the second elevator segment 1226B shown in FIGS. 12A and 12B), respectively. For example, as shown, the timing ring 1620 includes a first body segment 1621A and a second body segment 1621B. In one or more embodiments, the first body segment 1621A may include a recess 1622 formed therein and configured to receive a protrusion 1623 of the second body segment 1621B, or vice versa, and may mate at substantially opposite to a position in which a hinge 1628 couples a first elevator segment and a second elevator segment. In other words, the first body segment 1621A and the second body segment 1621B of the timing ring 1620 may be formed such that the timing ring 1620 may also move with a first elevator segment and a second elevator segment of a lifting elevator between an open position (as shown in FIGS. 13 and 14) and a closed position (as shown in FIG. 15).

The mating relationship between the recess 1622 of the first body segment 1621A and the protrusion 1623 of the second body segment 1621B of the timing ring 1620 may both body segments of the timing ring 1620 to move together. As shown in FIG. 16, the body segments (the first body segment 1621A and the second body segment 1621B) of the timing ring 1620 are brought into engagement with an interlocking structure that facilitates vertical movement in unison of the body segments of the timing ring 1620 together. In one or more embodiments, the timing ring 1620 may include two or more body segments. For example, referring back to FIG. 15, the lifting elevator 1518 may include a timing ring similar to the timing ring 1620 shown in FIG. 16, the timing ring of the lifting elevator 1518 having three segments. In one or more embodiments, the timing ring of the lifting elevator 1518 may include joints (e.g., as shown in FIG. 16) at the hinge 1528A, the hinge 1528B, and at the latch 1560. As discussed above, the timing ring 1620 may be thrust hydraulically, pneumatically, mechanically, or through any type of actuator known to those having ordinary skill in the art.

Advantageously, embodiments disclosed herein allow an elevator to engage and lift a (e.g., horizontally laying) joint of conductor pipe without requiring the elevator to be slid over a free end of the joint of conductor pipe. Furthermore, embodiments disclosed herein depict a method by which joints of conductor pipe may be assembled and thrust into the wellbore without the need for welded and/or bolted lifting eyes to be installed and removed from each joint of conductor pipe. Pursuant thereto, embodiments disclosed herein reduce likelihood that individual joints of conductor pipe may become damaged during assembly and installation processes. For example, a backstop may be coupled to the lifting elevator and may be configured to abut a joint of pipe and prevent the joint of pipe from directly contacting a first elevator segment and/or a second elevator segment at particular portions within the lifting elevator. Advantageously still, embodiments disclosed herein allow cylindrical joints of conductor pipe having no lifting features, e.g., upsets on the outer diameter of the pipe) to be lifted from a non-vertical position in a pipe rack or another rig location, grasped by a lifting elevator, rotated into a vertical position, and installed atop a string of conductor pipe.

While the disclosure has been presented with respect to a limited number of embodiments, those skilled in the art, having benefit of this disclosure, will appreciate that other embodiments may be devised which do not depart from the scope of the present disclosure. Accordingly, the scope of the invention should be limited only by the attached claims.

What is claimed is:

1. A lifting elevator, comprising:

a first elevator segment having a first plurality of slips;

a second elevator segment having a second plurality of slips;

a hinge about which both the first elevator segment and the second elevator segment are rotatable with respect to each other, wherein the first elevator segment and the second elevator segment each comprise a swept angle of about 180°;

a first lifting lug directly coupled to the first elevator segment;

a second lifting lug directly coupled to the second elevator segment, wherein the first lifting lug and the second lifting lug are configured to carry a load of a conductor string that includes the joint of pipe;

wherein each of the first plurality of slips and the second plurality of slips comprises a die configured to grip an external surface of a pipe;

a segmented timing ring coupled to the first plurality of slips and the second plurality of slips, wherein the segmented timing ring is actuated by one of a pneumatically, hydraulically, and electrically powered actuator;

wherein the lifting elevator is configured to laterally receive a joint of pipe between the first elevator segment and the second elevator segment when in an open position and the joint of pipe is disposed in a non-vertical position, and wherein the lifting elevator is configured to grip and reorient the joint of pipe from the non-vertical position to a vertical position and lowered into a well when the first plurality of slips and the second plurality of slips are engaged with the joint of pipe in a closed position.

2. The lifting elevator of claim 1, wherein the first elevator segment comprises a first tapered surface that the first plurality of slips are movably disposed along, and wherein the second elevator segment comprises a second tapered surface that the second plurality of slips are movably disposed along.

3. The lifting elevator of claim 1, further comprising:

a non-moveable back stop disposed between the first elevator segment and the second elevator segment.

4. The lifting elevator of claim 1, wherein the first lifting lug is positioned proximate to a middle of the first elevator segment, and wherein the second lifting lug is positioned proximate to a middle of the second elevator segment.

5. A method comprising:

opening a first elevator segment and a second elevator segment of a lifting elevator about a hinge connecting the first elevator segment and the second elevator segment, wherein the first elevator segment and the second elevator segment each comprise a swept angle of about 180°;

tilting the lifting elevator to a non-vertical position;

receiving a non-vertical joint of pipe within the opened, tilted lifting elevator;

closing the first elevator segment and the second elevator segment of the lifting elevator around the non-vertical joint of pipe;

gripping the non-vertical joint of pipe with a plurality of slips of the lifting elevator, wherein gripping the non-vertical joint of pipe with the plurality of slips comprises moving the plurality of slips in a downward direction in a tapered bowl via a connection between the plurality of slips and a segmented timing ring, wherein the segmented timing ring is actuated by one of a pneumatically, hydraulically, and electrically powered actuator;

lifting the gripped, non-vertical joint of pipe to a vertical position using the lifting elevator, wherein the lifting elevator includes a first lifting lug coupled to the first elevator segment and a second lifting lug coupled to the second elevator segment, and the first lifting lug and the second lifting lug are configured to carry a load of the joint of pipe;

positioning the vertical joint of pipe atop a conductor string;

attaching the vertical joint of pipe to the conductor string; and supporting the joint of pipe and the conductor string with the lifting elevator.

6. The method of claim 5, wherein receiving a non-vertical joint of pipe comprises:

abutting the joint of pipe against a non-moveable backstop disposed between the first elevator segment and the second elevator segment.

7. The method of claim 5, wherein the first lifting lug is positioned proximate to a middle of the first elevator segment, and wherein the second lifting lug is positioned proximate to a middle of the second elevator segment.

8. The method of claim 5, further comprising:

latching the first elevator segment to the second elevator segment of the lifting elevator closed around the non-vertical joint of pipe using a latch.

9. The method of claim 8, wherein:

the latch is pivotably connected to one of the first elevator segment and the second elevator segment.

10. The method of claim 5, wherein each of the plurality of slips of the lifting elevator comprise a die configured to grip an external surface of the joint of pipe.

* * * * *